United States Patent [19]

Hasegawa et al.

[11] Patent Number: 4,953,997

[45] Date of Patent: Sep. 4, 1990

[54] TRACTOR UNITS FOR PUSH-PULL PRINTER

[75] Inventors: Kazumi Hasegawa, Tokyo; Hiroshi Ikeda, Tokorozawa; Wataru Ito, Koganei, all of Japan

[73] Assignee: Citizen Watch Co., Ltd., Tokyo, Japan

[21] Appl. No.: 348,110

[22] Filed: May 2, 1989

Related U.S. Application Data

[63] Continuation of Ser. No. 91,129, Aug. 31, 1987, abandoned.

[30] Foreign Application Priority Data

Aug. 30, 1986 [JP] Japan ..... 61-202699

[51] Int. Cl.[5] ..... B41J 11/28

[52] U.S. Cl. ..... 400/616.3

[58] Field of Search ..... 400/616, 616.1, 616.2, 400/616.3

[56] References Cited

U.S. PATENT DOCUMENTS

| | | | |
|---|---|---|---|
| 3,753,483 | 8/1973 | Lundquist et al. | 400/616.2 |
| 4,269,522 | 5/1981 | Levinson et al. | 400/616.3 X |
| 4,440,516 | 4/1984 | Rosenthal et al. | 400/616.1 |
| 4,571,103 | 2/1986 | Takeo et al. | 400/616.2 |

FOREIGN PATENT DOCUMENTS

| | | | |
|---|---|---|---|
| 155578 | 10/1952 | Australia | 400/616.2 |
| 0191984 | 8/1986 | European Pat. Off. | 400/616.2 |
| 118886 | 9/1980 | Japan | 400/616.2 |
| 0014073 | 1/1982 | Japan | 400/616.1 |
| 0052377 | 3/1985 | Japan | 400/616.1 |
| 0230879 | 11/1985 | Japan | 400/616.1 |
| 0144370 | 7/1986 | Japan | 400/616.1 |
| 428617 | 7/1967 | Switzerland | 403/354 |
| 869891 | 6/1961 | United Kingdom | 400/616.1 |

OTHER PUBLICATIONS

Kroeker, "Detachable Printer Pin Feed", *IBM Tech. Disc. Bul.*, vol. 18, No. 11, p. 3536, Apr., 1976.

Darwin et al., "Bidirectional Printer Carriage", IBM Tech. Disc. Bul., vol. 15, No. 1, Jun. 1972, p. 157.

*Primary Examiner*—Clifford D. Crowder

*Attorney, Agent, or Firm*—Lowe, Price, LeBlanc, Becker & Shur

[57] ABSTRACT

A push-pull printer includes at least one tractor unit thus is formed to have both a pull function and a push function. Fork-like mounting portions are respectively formed at lower portions of a pair of frames provided at both ends of the tractor unit. A pair of tractor guides are located at each of push and pull feed positions of the printer body. Each guide detachably holds a corresponding fork-like mounting portion. When the tractor is to be used in the push type paper feed mode, the fork-like mounting portions are attached to the tractor guides located at the push feed position. However, for use in the pull type paper feed mode, the fork-like mounting portions are attached to the tractor guides located at the pull feed position. Two such tractors, one providing the pull function and the other the push function, can be used cooperatively.

8 Claims, 4 Drawing Sheets

TRACTOR UNITS FOR PUSH-PULL PRINTER

This application is a continuation of application Ser. No. 07/091,129, filed Aug. 31, 1987, now abandoned.

BACKGROUND OF THE INVENTION

The present invention relates to a continuous form paper feeder for a printer serving as a terminal output device.

In a conventional printer of this type, fan-fold paper (folded continuous form paper) is used. There are two types of continuous form paper feeders, namely, the push and the pull type.

In a push type continuous form paper feeder, paper is fed upward between a printing head and a platen, and printing can be performed from the upper end of paper. Therefore, so-called "inch cut" can be performed. When printing is frequently performed in a small amount each time, the push type continuous form paper feeder is advantageous.

In a pull type continuous form paper feeder, paper passing through a gap between a printing head and a platen is pulled upward, and the "inch cut" cannot be performed. However, "bottom feed" can be performed wherein paper is inserted from a paper insertion port open widely at the bottom of the printer. In this continuous form paper feeder, paper tension and stiffness need not be taken, into consideration, and paper is rarely ramped or otherwise impeded during feeding. High precision of paper feeding can thus be achieved. Therefore, the pull type continuous form paper feeder is advantageous when printing is performed in a large amount each time.

In the early stage, pull type continuous form paper feeders had been very popular as printers at terminal output devices. However, improved paper holding techniques have been developed, and high-precision push type continuous form paper feeders have also been introduced. In recent years, the push and pull type continuous form paper feeders have become competitive.

Although the conventional push and pull type continuous form paper feeders for printers present unique independent advantages, they have controversial factors. Therefore, it is convenient to use the push or pull type continuous form paper feeder on proper occasions according to conventional applications.

However, conventional printers can employ only a push or pull type continuous form paper feeder. In addition, a tractor unit as a continuous form paper feeder is typically built into or fixed to a printer body. Alternatively, as shown in FIG. 4, even if the tractor unit is detachable from the printer body, the tractor is detached for operational convenience only for feeding or inspection. The tractor unit must be mounted on the printer body at a given position, e.g., the pull feed position in FIG. 4.

SUMMARY OF THE INVENTION

It is an object of the present invention to provide a push-pull printer capable of employing push and pull type continuous form paper feeders and selectively using a push or a pull type continuous form paper feeder by utilizing their unique independent advantages as needed.

It is another object of the present invention to provide a simple, inexpensive push-pull printer which can be easily handled.

According to the present invention, a push-pull printer comprises a printer body having push and pull positions, at least one tractor unit, first mounting means having a first mounting portion secured to the push feed position of the printer body with the first mounting means being arranged to detachably support a corresponding one of the at least one tractor unit at the push feed position, and second mounting means having a second mounting portion secured to the pull feed position of the printer body with the second mounting means being arranged to detachably support a corresponding one of the at least one tractor unit at the pull feed position.

DETAILED DESCRIPTION OF THE PREFERRED EMBODIMENT

Figure 2:
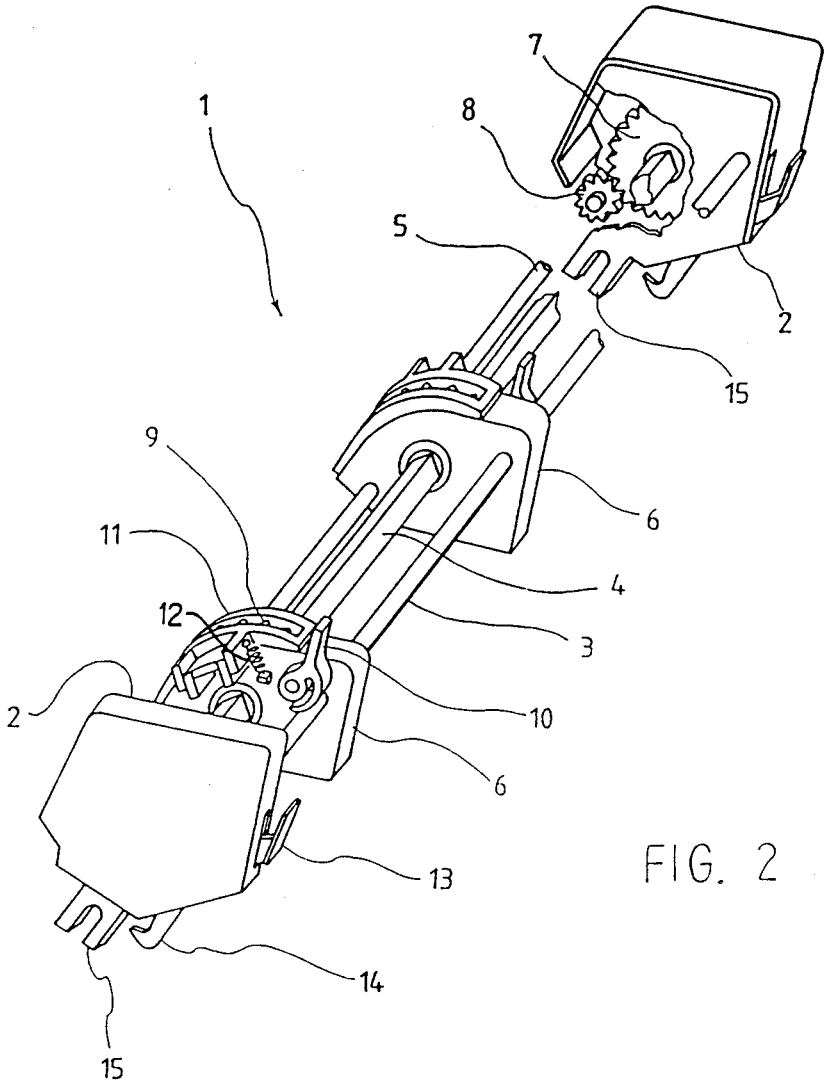
FIG. 2 is a perspective view of a tractor unit.
Figure 3:
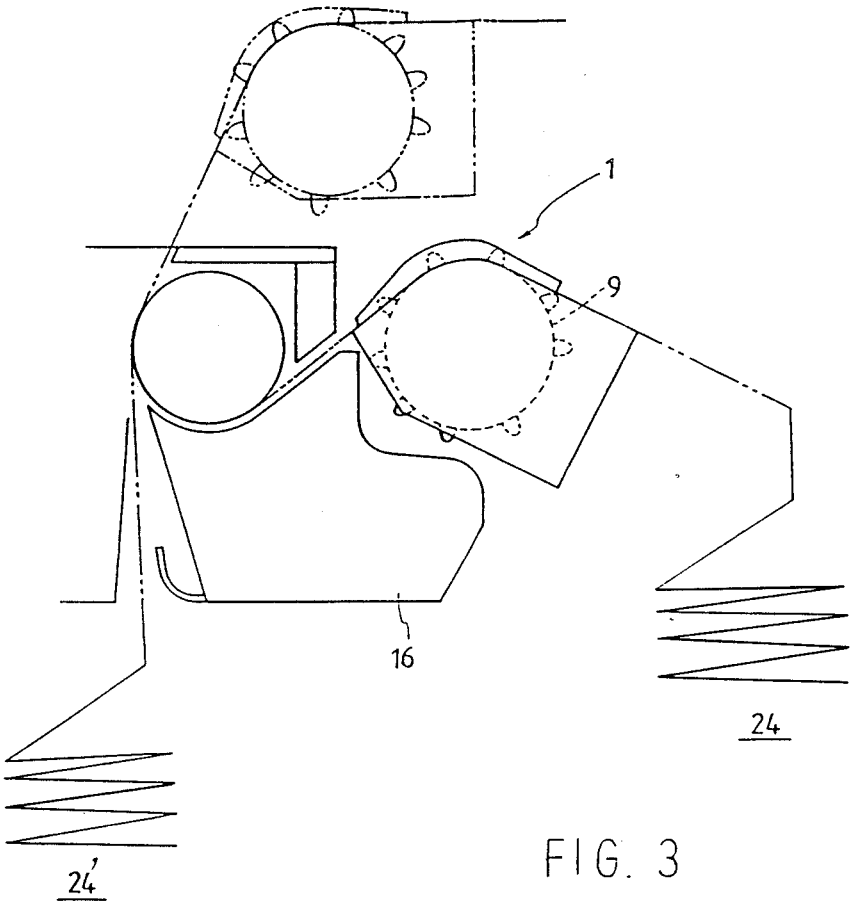
FIG. 3 is a view showing paper feed paths when the tractor unit is located at the push and pull feed positions.
Figure 4:
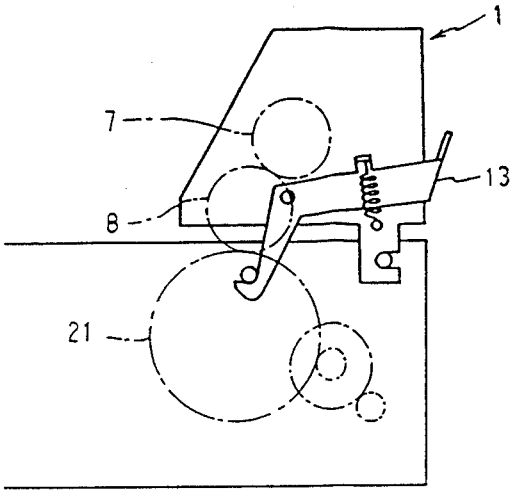
FIG. 4 (PRIOR ART)
FIG. 4 is a schematic view showing a conventional printer.

Referring to FIG. 2, a tractor unit 1 comprises frames 2, 2 located at the left and right ends thereof. A guide rod 3, a shaft 4, and a tie rod 5 are disposed in parallel to each other between the frames 2, 2. Right and left tractors 6 are mounted on the elements 3 to 5 for slidable motion between the frames 2 in the right-and-left direction to vary their positions. Both ends of the guide rod 3 and the tie rod 5 are fixed to the right and left frames 2, 2. The shaft 4 comprising a square rod has one end to which a tractor gear 7 is fixed at a location inside one frame 2, and the other end rotatably supported by the other frame 2. An idler gear 8 is meshed with the tractor gear 7 and is rotatably supported by the corresponding frame 2. The tractors 6, 6 are the same in construction and are disposed symmetrically with each other. Each tractor 6 comprises a case and a pin wheel 9 mounted in the case. The shaft (square rod) 4 extends through the pin wheel. A lock lever 10 and an openable wheel cover 11 are disposed at locations outside the case of each tractor 6. Reference numeral 12 denotes a reversal spring for holding the wheel cover 11 to an open or closed position. Set levers 13 are respectively disposed at an outer surface side of the right and left frames 2 and are arranged pivotally to actuate corresponding hooks 14.

Fork-like mounting portions 15, 15 are formed at the lower portions of the right and left frames, respectively.

Figure 1:
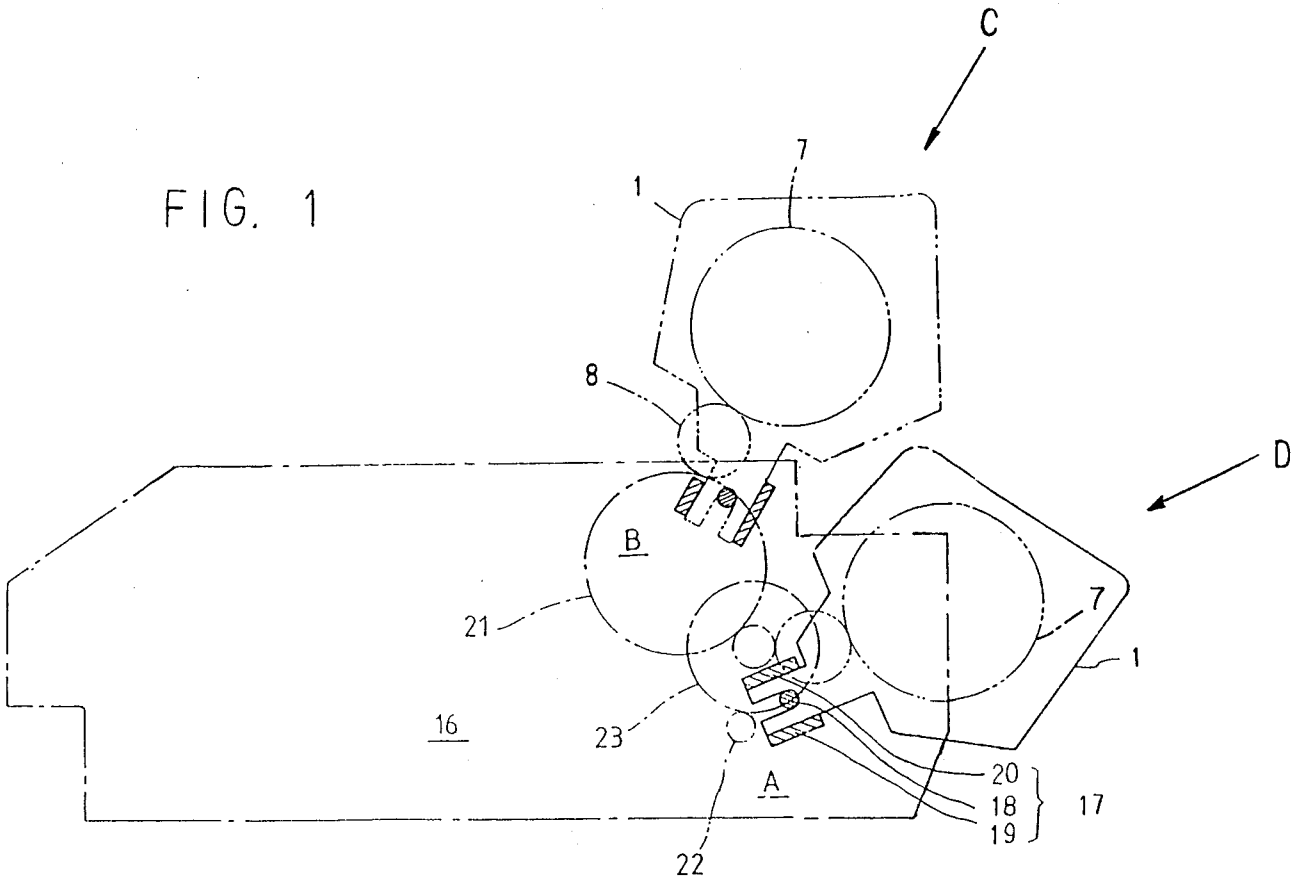
FIG. 1 is a schematic view showing the main part of a push-pull printer according to an embodiment of the present invention.

Tractor guides 17 having the same structure are disposed at push and pull feed positions A and B at the right and left sides (only the right side is illustrated) of the rear portion of the printer body 16, as shown in FIG. 1.

More specifically, each tractor guide 17 comprises a central engaging pin 18 extending from a frame (mechanism frame) (not shown) for supporting mechanisms in the printer body, and two projections 19 and 20 disposed at both sides of the engaging pin 18 in a manner facing the pin. The projections 19 and 20 project from the frame and are separated from each other with respect to the pin 18 as the center by the same distance as the width of the fork-like mounting portion 15.

Each tractor guide 17 constituted by the engaging pin 18 and the two projections 19 and 20 is adapted to be detachably engaged with the fork-like mounting portion 15 of the corresponding frame 2 of the tractor unit 1 to form a typical example of means for locating and fixing the tractor unit 1 to one or both of the push and pull feed positions A and B. Alternatively, the locating and fixing means may be arranged as follows. The mounting portion 15 is elongated to constitute a collapsible arm, and the position of the arm is changed by swinging about one axis of the distal end at a arm.

The printer body 16 includes a platen gear 21 as an element of its structural mechanism. The gear 21 is meshed with a motor gear 22 of a drive source through a two-stepped idler gear 23.

The push and pull feed positions A and B of the tractor guide 17 are respectively located above and below the platen position represented by the platen gear 21, as shown in FIG. 1. The upstream position of the paper feed direction is the push feed position A, and the downstream position of the paper feed direction is the pull feed position B. The positions and direction of the projections 19 and 20 and the engaging pin 18 which are located at the push feed position A are determined such that a line connecting the center of the platen gear 21 and the center of the tractor gear 7 mounted on the elements 18 to 20 extends substantially horizontally. At the pull feed position B, the positions and direction of the elements 18 to 20 are determined such that the line connecting the above gears forms an angle of about 50° with respect to the horizontal line. In addition, the elements 18 to 20 are located at positions such that the idler gear 8 of the tractor unit 1 is meshed with a second-step, i.e., small-diameter gear (position A) of the idler gear 23 of the platen gear 21 and with the platen gear 21 (position B). It should be noted that the direction along which the mounting portion 15 of the tractor unit 1 is inserted varies primarily depending on the angle of the mounting portion of the frame 2. Insertion directions of each mounting portion 15 for the corresponding tractor guide 17 are given such that the push and pull tractor mounting directions are represented by arrows C and D in FIG. 1.

The rear side of the printer body 16 must be designed so that it does not interfere with mounting of the tractor unit 1 at either of the positions A and B. When the tractor unit 1 is to be attached to the printer body 1, the user is required to simply push the unit so that the hooks 14 are respectively engaged with lock pins (not shown) on the printer body 16. When the tractor unit 1 is to be detached from the printer body 16, the user pushes the set levers 13 in a known manner to disengage the hooks 14 from the lock pins (not shown) in the printer body 16.

With the above structure, in order to use the printer in the push type paper feed mode, the tractor unit 1 is attached to the tractor guides 17 at the push feed position A, and fan-fold paper 24 is engaged with the pin wheel 9 of the tractor unit 1 from the backward direction. The paper is held by the wheel cover 11 and is pulled upward through the gap between the platen and a print head (not shown). In this state, normal printing is performed. The fan-fold paper 24 is sequentially fed upon intermittent rotation of the pin wheels 9 through the tractor gears 7 and the shaft 4.

When a pull type paper feed mode is preferred, the tractor unit 1 is detached from the tractor guides 17 at the push feed position A and is then inserted into the corresponding tractor guides 17 at the pull feed position B. The leading end of the fan-fold paper 24 is then inserted between the printing head and the platen and is engaged with the pin wheels 9 of the tractor unit 1 located in the position B. In this case, the paper is fed in the pull type paper feed mode, and normal printing is performed as described above. In the pull type paper feed mode, bottom feeding as indicated by fan-fold paper 24' also can be performed. In this case, a paper feed port must be formed in the lower surface of the rear portion of the printer body 16 and must be of a size corresponding to the width of the fan-fold paper.

Two tractor units 1 may be prepared and may be respectively attached to the push and pull feed positions. These tractor units may be selectively used as needed.

What is claimed is:

1. A push-pull printer, comprising:

a printer body having push and pull feed positions;

at least one tractor unit;

first mounting means having a first mounting portion secured to said push feed position of said printer body, said first mounting means being arranged to detachably support a corresponding one of said at least one tractor unit at said push feed position; and second mounting means having a second mounting portion secured to said pull feed position of said printer body, said second mounting means being arranged to detachably support a corresponding one of said at least one tractor unit at said pull feed position, wherein each of said at least one tractor unit is provided at its opposite end portions with a pair of frames; said first mounting means having a first pair of projections secured at said push feed position of said printer body, a first engaging pin secured between said projections and cooperating with said first pair of projections to form said first mounting portion, and a first fork-like mounting portion formed in a lower portion of each of the pair of frames of the tractor unit associated with said first mounting means and detachably supported by said first pair of projections and said first engaging pin; and said second mounting means having a second pair of projections secured to said pull feed position of said printer body, a second engaging pin secured between said projections and cooperating with said second pair of projections to form said second mounting portion, and a second fork-like mounting portion formed in a lower portion of each of the pair of frames of the tractor unit associated with said second mounting means and detachably supported by said second pair of projections and said second engaging pin.

2. A push-pull printer according to claim 1, wherein:

each said at least one tractor unit has a driving shaft extending between said pair of frames and rotatably supported at its opposite ends by said frames, a tractor supported at its opposite ends by said frames, a tractor operatively coupled to said driving shaft, and a driven gear means operatively coupled to an end portion of said driving shaft; said printer body having a platen gear which is rotatable in unison with a platen, and a driving gear means operatively coupled to a driving source; whereby when said at least one tractor unit is mounted at said push or pull feed position, said driving shaft thereof is coupled to said driving gear means through said driven gear means or though said driven gear means and said platen gear.

3. A push-pull printer according to claim 2, wherein: said printer body has a paper feed port which is formed at a location below said platen, whereby a paper is supplied to said at least one tractor unit mounted at said pull feed position through said paper feed port.

4. A push-pull printer according to claim 2, wherein: said driven gear means has a tractor gear which is rotatable in unison with said driving shaft, and an idle gear meshing therewith; said driving gear means having a motor gear, a two-stepped idle gear which has a large-diameter gear portion meshing with said motor gear and a small-diameter gear portion meshing with said platen gear; whereby said idle gear of said at least one tractor unit is in mesh with said small-diameter gear portion of said two-stepped idle gear when said at least one tractor unit is mounted at one of said pull and push feed position, whereas said idle gear is in mesh with said platen gear when said at least one tractor unit is mounted at the other of these positions, so that said driving shaft of said at least one tractor unit is coupled to said driving gear means.

5. A push-pull printer according to claim 1, wherein: said printer body has a paper feed port which is formed at a location below a platen, whereby a paper is supplied to said at least one tractor unit mounted at said pull feed position through said paper feed port.

6. A push-pull printer, comprising:

a printer body having push and pull feed positions;

at least one tractor unit formed to be detachably mounted to said printer body;

first mounting means having a first mounting portion secured to said push feed position of said printer body, said first mounting means being arranged to detachably support a corresponding one of said at least one tractor unit at said push feed position; and second mounting means having a second mounting portion secured to said pull feed position of said printer body, said second mounting means being arranged to detachably support a corresponding one of said at least one tractor unit at said pull feed position, and said first and second mounting portions of said first and second mounting means are disposed with respect to each other so as to enable optional mounting thereat of two tractor units simultaneously, said at least one tractor unit having both a push feed function and a pull feed function, whereby a selected one of said push and pull functions thereof is utilized by mounting said at least one tractor unit at a corresponding one of said first and second mounting positions, wherein each said at least one tractor unit has a pair of frames respectively formed in opposite end portions thereof, a driving shaft extending between said frames and rotatably supported at its opposite ends by said frames, a tractor operatively coupled to said driving shaft, and a driven gear means operatively coupled to an end portion of said driving shaft, said printer body having a platen gear which is rotatable in unison with a platen and a driving gear means operatively coupled to a driving source, whereby when said at least one tractor unit is mounted at said push or pull feed position said driving shaft thereof is coupled to said driving gear means through said driven gear means or through said driven gear means and said platen gear.

7. A push-pull printer according to claim 6, wherein: said driven gear means has a tractor gear which is rotatable in unison with said driving shaft, and an idle gear meshing therewith; said driving gear means having a motor gear, a two-stepped idle gear which has a large-diameter gear portion meshing with said motor gear and a small-diameter gear portion meshing with said platen gear; whereby said idle gear of said at least one tractor unit is in mesh with said small-diameter gear portion of said two-stepped idle gear when said at least one tractor unit is mounted at one of said pull and push feed positions, whereas said idle gear is in mesh with said platen gear when said at least one tractor unit is mounted at the other of these positions, so that said driving shaft of said at least one tractor unit is coupled to said driving gear means.

8. A push-pull printer according to claim 6, wherein: said printer body has a paper feed port which is formed at a location below said platen, whereby a paper is supplied to said at least one tractor unit mounted at said pull feed position through said paper feed port.

* * * * *